US007293627B2

(12) United States Patent
Krüger et al.

(10) Patent No.: US 7,293,627 B2
(45) Date of Patent: Nov. 13, 2007

(54) ACTIVE EXHAUST MUFFLER

(75) Inventors: Jan Krüger, Neuhausen (DE); Frank Castor, Esslingen (DE)

(73) Assignee: J. Eberspeecher GmnH (DE)

( * ) Notice: Subject to any disclaimer, the term of this patent is extended or adjusted under 35 U.S.C. 154(b) by 249 days.

(21) Appl. No.: 11/205,753

(22) Filed: Aug. 17, 2005

(65) Prior Publication Data

US 2006/0037808 A1 Feb. 23, 2006

(30) Foreign Application Priority Data

Aug. 19, 2004 (DE) ..... 10 2004 040 421

(51) Int. Cl.

| | |
|---|---|
| ***F01N 1/06*** | (2006.01) |
| ***F01N 1/02*** | (2006.01) |
| ***G10K 11/16*** | (2006.01) |
| *F10N 1/04* | (2006.01) |
| *F10N 1/08* | (2006.01) |

(52) U.S. Cl. ..... 181/206; 181/250; 181/272; 181/273; 181/276; 381/71.5; 381/71.7

(58) Field of Classification Search ..... 181/206, 181/250, 272, 273, 276; 381/71.5, 71.7, 381/71.1, 71.4

See application file for complete search history.

(56) References Cited

U.S. PATENT DOCUMENTS

| | | | | |
|---|---|---|---|---|
| 4,177,874 | A | 12/1979 | Angelini et al. | |
| 4,527,282 | A * | 7/1985 | Chaplin et al. | 381/71.5 |
| 5,044,464 | A * | 9/1991 | Bremigan | 181/206 |
| 5,097,923 | A * | 3/1992 | Ziegler et al. | 181/206 |
| 5,229,556 | A | 7/1993 | Geddes | |
| 5,233,137 | A | 8/1993 | Geddes | |
| 5,257,316 | A * | 10/1993 | Takeyama et al. | 381/71.5 |
| 5,319,165 | A | 6/1994 | Geddes | |
| 5,336,856 | A | 8/1994 | Krider et al. | |
| 5,432,857 | A | 7/1995 | Geddes | |
| 5,446,790 | A * | 8/1995 | Tanaka et al. | 381/71.14 |
| 5,457,749 | A | 10/1995 | Cain et al. | |
| 5,513,266 | A * | 4/1996 | Zuroski | 381/71.5 |
| 5,600,106 | A | 2/1997 | Langley | |
| 5,619,020 | A | 4/1997 | Jones et al. | |
| 5,693,918 | A * | 12/1997 | Bremigan et al. | 181/206 |
| 6,160,892 | A * | 12/2000 | Ver | 381/71.5 |
| 6,758,304 | B1 * | 7/2004 | McLean | 181/206 |
| 6,963,647 | B1 * | 11/2005 | Krueger et al. | 381/71.5 |
| 7,006,639 | B2 * | 2/2006 | Hobelsberger | 381/96 |
| 2007/0045043 | A1 * | 3/2007 | Hoerr et al. | 181/250 |

FOREIGN PATENT DOCUMENTS

| | | |
|---|---|---|
| DE | 8433384 | 2/1985 |
| DE | 4428493 | 2/1995 |
| DE | 19754595 | 6/1998 |
| EP | 0373188 | 6/1990 |
| EP | 0674097 | 9/1995 |
| EP | 0916817 | 5/1999 |
| EP | 1055804 | 11/2000 |

* cited by examiner

*Primary Examiner*—Edgardo San Martin
(74) *Attorney, Agent, or Firm*—Plevy, Howard & Darcy, PC

(57) ABSTRACT

An active exhaust muffler for an exhaust system of an internal combustion engine, having a housing through which a pipe system passes, the pipe system designed to be permeable for airborne sound in a first space, having an antisound generator which is arranged in a second space and antisound acting upon a third space through a wall opening during operation, the wall opening being provided in a partition that separates the second space from the third space, whereby airborne sound is transmitted from the first space to the third space through a sound outlet. To increase the lifetime of the antisound generator and thus the exhaust muffler, a labyrinth is provided in the third space, blocking a direct path between the sound outlet and the wall opening, and providing at least one indirect bypass for the propagation of airborne sound between the sound outlet and the wall opening.

28 Claims, 1 Drawing Sheet

ACTIVE EXHAUST MUFFLER

FIELD OF INVENTION

The present invention relates to an active exhaust muffler for an exhaust system of an internal combustion engine, in particular in a motor vehicle.

BACKGROUND OF INVENTION

Such an exhaust muffler is known from EP 1 055 804 B1, for example, and has a housing through which a pipe passes. This pipe is designed so that it is permeable for airborne sound in a first space due to the fact that it has a perforated pipe section in the first space. In addition, the known exhaust muffler has an antisound generator in the form of a loudspeaker arranged in a second space. During operation of the exhaust muffler, the antisound generator generates antisound to act on a third space through a wall opening. Said wall opening is provided in a partition separating the second space from the third space. In addition, the first space communicates with the third space through a sound outlet for transmission of airborne sound.

Additional active exhaust mufflers are described in EP 0 373 188 B1, U.S. Pat. No. 5,233,137, U.S. Pat. No. 4,177,874, U.S. Pat. No. 5,229,556, U.S. Pat. No. 5,336,856, U.S. Pat. No. 5,319,165, U.S. Pat. No. 5,432,857, EP 0 674 097 A1, U.S. Pat. No. 5,619,020, U.S. Pat. No. 5,600,106, EP 0 916 817 and DE 197 51 596.

During operation of such an active exhaust muffler, the airborne sound to be suppressed is output from the pipe in the first space and is introduced through the sound outlet into the third space. At the same time, antisound, i.e., sound with a reciprocal pressure level characteristic in comparison with that of the sound to be absorbed, is generated and supplied to the third space with the help of the loudspeaker. Then in the third space there is a mutual extinction of sound and antisound, thus characterizing an active exhaust muffler of the present type.

In theory, effective noise suppression can be achieved with the help of such an active exhaust muffler. In practice, however, serious problems occur because of the high temperatures prevailing in the exhaust and because the loudspeakers available in the past have not had a long enough lifetime at such high operating temperatures. Furthermore, the loudspeakers required in active exhaust mufflers must be very powerful to be able to respond appropriately to the extremely high sound pressure levels prevailing in the exhaust and to be able to achieve the desired noise suppression effect. However, a high power level leads to a high additional heat production in the loudspeaker.

SUMMARY OF THE INVENTION

The present invention is based on the general idea of preventing the sound that is to be suppressed from acting directly on the loudspeaker; this is accomplished by blocking the direct path between the sound outlet and the wall opening for the transmission of sound and instead providing at least one bypass by way of which the airborne sound can travel from the sound outlet to the wall opening only indirectly. This is then also true accordingly for the hot exhaust. The sound to be suppressed does not act directly on the loudspeaker and therefore the loudspeaker is also not exposed to the hot gases, therefore at the same time the thermal burden on the loudspeaker and/or the antisound generator that is also used may be reduced, since a direct thermal burden, e.g., due to thermal radiation from the sound outlet to the wall opening, is automatically prevented by blocking the direct path between the sound outlet and the wall opening. A reduced thermal burden on the antisound generator is associated with a longer lifetime of the antisound generator and therefore also the active exhaust muffler.

In an embodiment of the invention, blocking the direct path between the sound outlet and the wall opening is accomplished with the help of a labyrinth, which is designed for this purpose in the third space. The labyrinth here blocks the aforementioned direct path and thus at the same time also creates at least one indirect bypass. At the same time, the labyrinth is expediently designed with thermal insulation in a suitable manner while at the same time being designed to be acoustically transparent so that there is essentially no sound absorption on the path from the wall opening to the sound outlet. Therefore, almost all the acoustic power of the antisound generator is available for suppressing or silencing, the sound transmitted through the exhaust.

The labyrinth is preferably equipped with at least one insulation wall which completely covers or shades the sound outlet as well as the wall opening and on at least one edge permits transmission of airborne sound between a first side of the insulation wall facing the sound outlet and a second side of the insulation wall facing the wall opening. The airborne sound is guided along the respective bypass around the insulation wall. During operation, the insulation wall may thus insulate against the heat emitted at the sound outlet, so that the wall opening situated beyond the insulation wall and the antisound generator are therefore protected from direct heat exposure.

According to another embodiment, at least one additional space or a fourth space designed as a Helmholtz resonator may be provided in the housing, with the pipe system connected to this space upstream from the first space. Integrating the Helmholtz resonator into the housing of the sound absorber results in an especially compact design. Because of the arrangement of the Helmholtz resonator upstream from the first space, the sound pressure levels in the sound supplied to the sound absorber can be greatly suppressed in the resonant frequency range of the Helmholtz resonator, thereby preventing critical acoustic loads of the antisound generator in this resonant frequency range, which is also associated with a longer lifetime of the antisound generator and thus for the sound absorber.

It is self-evident that the features mentioned above, which are to be explained in greater detail below, may be used not only in the particular combination given but also in other combinations or alone without going beyond the scope of the present invention.

BRIEF DESCRIPTION OF THE FIGURE

A preferred exemplary embodiment of the invention is illustrated in the drawing and explained in greater detail in the following description.

DETAILED DESCRIPTION

Figure 1:
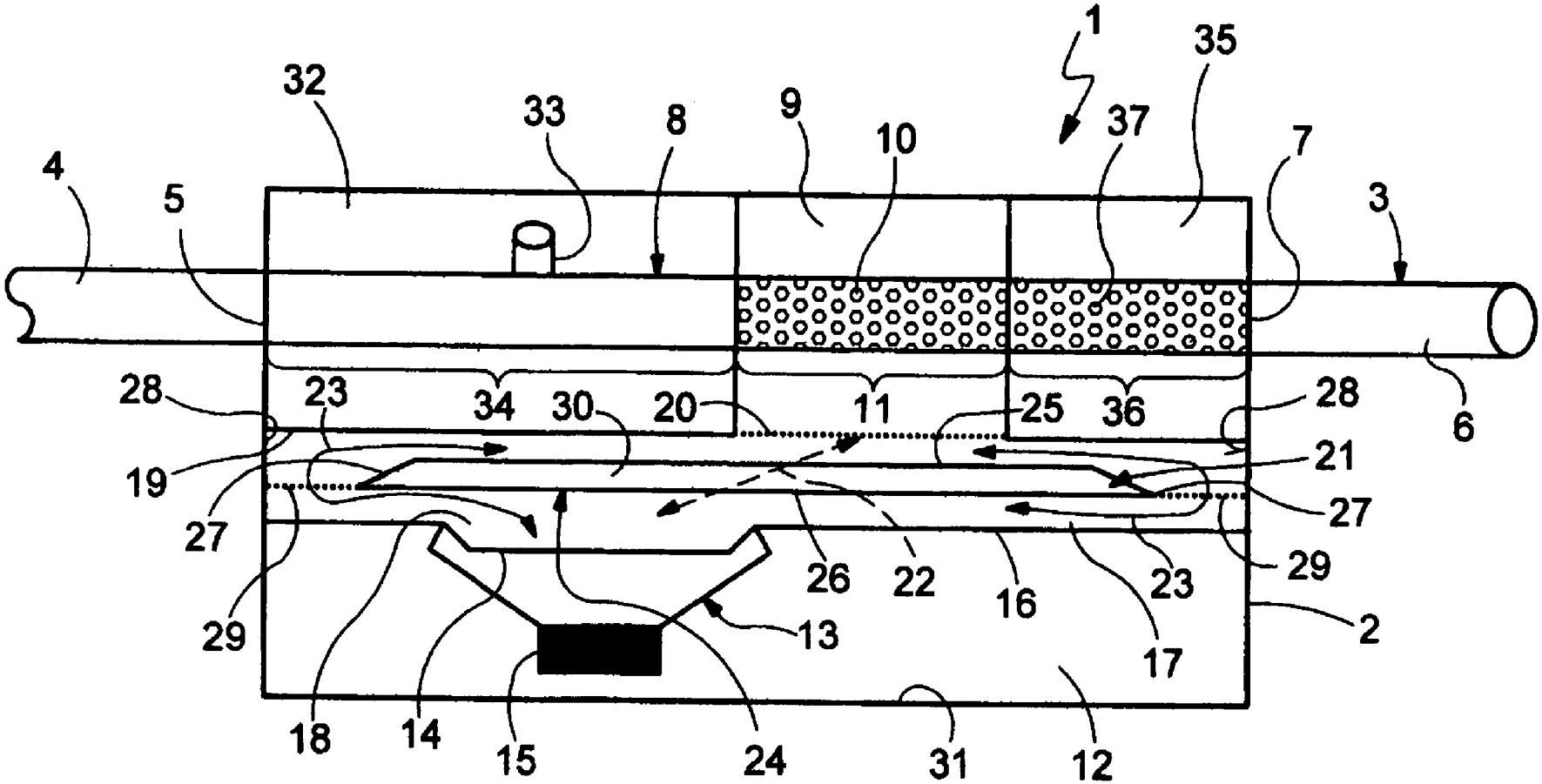
FIG. 1, the only figure, shows a greatly simplified schematic longitudinal section through an active exhaust muffler according to an embodiment of the invention.

According to FIG. 1, an active exhaust muffler 1 includes a housing 2 within which the exhaust muffler 1 can be incorporated into an exhaust gas system 3 (shown only partially here) of an internal combustion engine, which is not otherwise shown and which may be arranged in a motor vehicle. An intake pipe 4 in the installed state leads from the internal combustion engine to an exhaust inlet 5 of the housing 2. Accordingly, an outlet pipe 6 leads from an exhaust outlet 7 of the housing 2 into the environment of the internal combustion engine.

The exhaust inlet 5 communicates with the exhaust outlet 7 without any mentionable flow resistance via a pipe system 8 which passes through the housing 2. In the preferred embodiment shown here, the pipe system 8 is formed by a single pipe connecting the exhaust inlet 5 directly to the exhaust outlet 7 and in particular in a straight line.

A first space 9 is formed in the housing 2 with the pipe and/or pipe system 8 passing through it. The pipe system 8 in the first space 9 is designed to be permeable for airborne sound, which is expediently accomplished by means of a corresponding perforation 10 in a pipe section 11 of the pipe system 8 running in the first space 9.

In addition, the housing 2 contains a second space 12 in which an antisound generator 13 is provided. The antisound generator 13 has an airtight membrane 14 and an energizer or motor 15 which is capable of energizing the membrane 14 to vibration to generate antisound. The antisound generator 13 is usually designed as a loudspeaker. A partition 16 separates the second space 12 from the third space 17 and includes a wall opening 18 through which the antisound generator 13 can emit antisound into the third space 17. The antisound generator 13 is expediently positioned in the second space 12 in such way that it seals the wall opening 18 so that it is airtight.

The third space 17 is also bordered on the opposite side from the partition 16 by a bordering wall 19 which preferably runs parallel to the partition 16. A sound outlet 20 provided in this bordering wall 19 is designed to be permeable for airborne sound and allows the first space 9 to be in communication with the third space 17 for transmission of airborne sound. For example, the airborne sound outlet 20 may be formed by a perforated section of the bordering wall 19 or by a membrane capable of vibration.

According to an embodiment of the invention, a labyrinth 21 is provided in the third space 17. This labyrinth 21 is designed so that it blocks a direct path 22 for propagation of airborne sound between the sound outlet 20 and the wall opening 18, said direct path being indicated by a broken line. At the same time, the labyrinth 21 forms at least one bypass, or in the present case, it forms two bypasses 23 which permit indirect propagation of airborne sound between the sound outlet 20 and the wall opening 18.

Due to the fact that the direct path 22 is blocked and the bypasses 23 have been created, at the same time, the thermal burden on the antisound generator 13 is greatly reduced because it is no longer in the direct path 22. The labyrinth 21 is expediently designed as a thermal insulator, at least in the area of the direct path 22.

In the preferred embodiment depicted here, the labyrinth 21 has at least one insulation wall 24 which is arranged in the third space 17 and is also dimensioned so that it completely covers the sound outlet 20 as well as the wall opening 18. The insulation wall 24 here has a first side 25 which faces the sound outlet 20 and a second side 26 which faces the wall opening 18. The arrangement and dimensions of the insulation wall 24 in the third space 17 are such that airborne sound transmission can also take place between the first side 25 and the second side 26, at least in an edge area 27 of the insulation wall 24. In other words, the respective bypasses 23 lead through the respective edge area 27 of the insulation wall 24 or the respective wall areas 27 around the insulation walls 24.

The insulation wall 24 may be arranged with its respective edge area 27 at a distance from an outside wall 28 in order to implement the bypasses 23. Furthermore, FIG. 1 shows an alternative embodiment in which the insulation wall 24 is designed in the edge area 27 to be permeable for airborne sound; this can be achieved with the help of a corresponding perforation 29, for example.

The insulation wall 24 is expediently designed at least partially as a thermal insulator. It may preferably be designed as a hollow wall—as in the present case—and may accordingly contain a hollow space 30 in its interior. This hollow space 30 may expediently be filled with a thermal insulation material such as rock wool or glass wool. It is likewise expedient to manufacture the insulation wall 24 itself from a thermal insulation material. The insulation wall 24 is arranged in the third space 17 so that it extends parallel to the partition 16 and parallel to the bordering wall 19. The insulation wall 24 may also be arranged symmetrically in the third space 17—as is the case here.

In the embodiment shown in FIG. 1, the wall opening 18 is arranged with an offset with respect to the sound outlet 20. In other words, the wall opening 18 and the sound outlet 20 are arranged in such a way that they are not flush with one another and have little or no overlap. Due to this offset, the thermal burden on the partition 16 is also offset in relation to the wall opening 18 and is therefore offset in relation to the antisound generator 13.

In the embodiment shown here, the antisound generator 13 is mounted on the partition 16 in such a way that it is at a distance from a wall 31 that otherwise borders the second space 12. In other words, the antisound generator 13 is arranged completely within the housing 2 but is not thermally connected directly to it but instead is connected only indirectly via the partition 16. The second space 12 is expediently designed with a gastight seal with respect to the outside.

According to another embodiment, another space 32 may be provided in the housing 2, this space also being referred to below as the fourth space 32. This fourth space 32 is designed as a Helmholtz resonator, to which the pipe system 8 is connected, namely upstream from the first space 9. The connection of the pipe system 8 to the fourth space 32 is accomplished here via a neck 33. With a pipe section 34, the pipe system 8 expediently passes through the fourth space 32. The fourth space 32 is also designed to be airtight with respect to the outside. Noise suppression upstream from the first space 9 can reduce the sound pressure level amplitudes in a critical vibration range to such an extent that the burden on the downstream antisound generator 13 is greatly reduced. The Helmholtz resonator in the fourth space 32 is expediently tuned so that the following equation holds:

$$f_{res}=c_{T,p}/4L_{ZR}$$

where:

$f_{res}$=resonant frequency of the Helmholtz resonator, $C_{T,p}$=velocity of sound in the intake pipe 4 upstream from the sound generator 1, $L_{ZR}$=acoustically active length of the inlet pipe 14 from the exhaust muffler 1 to the next exhaust muffler located upstream in the direction of the internal combustion engine or to the next volume element in general, such as a central exhaust muffler.

In the embodiment shown here, another space 35 which may also be formed in the housing 2 is referred to below as the fifth space 35. The fifth space 35 is expediently designed as an absorption chamber to which the pipe system 8 is connected downstream from the first space 9. With a pipe section 36, the pipe system 8 expediently passes through the fifth space 35. For the acoustic connection of the pipe system 8 to the absorption chamber, the pipe section 36 is designed to be permeable for airborne sound; this is expediently accomplished with the help of perforations 37. The fifth space 35 is filled with a sound-absorbing material, preferably rock wool or glass wool. Moreover, the fifth space may also be designed to be airtight with respect to the outside.

For acoustic reasons, the outlet pipe 6 may have a length of 100 mm to 1000 mm, preferably 200 mm to 500 mm; this length is selected in a controlled manner to reduce the sound in the first space 9 through reflection at the end of the pipe. In other words, the outlet pipe 6 is expediently designed as a $\lambda/4$ pipe, which may be tuned to interfering residual frequencies in particular, which still occur in the first space 9 despite the effective silencing by the antisound generator 13.

The inventive active exhaust muffler 1 may be extremely compact due to the integration of the Helmholtz resonator (fourth space 32) and/or the absorption chamber (fifth space 35).

What is claimed is:

1. An active exhaust muffler for an exhaust system of an internal combustion engine, said muffler comprising:

a pipe system, adapted to be permeable for airborne sound in a first space;

a housing through which said pipe system passes;

a partition having a wall opening, said partition separating a second space from a third space;

an antisound generator situated in said second space and acting upon said third space with antisound through said wall opening during operation;

a sound outlet to transmit airborne sound, said first space in communication with said third space through said sound outlet; and a labyrinth provided in said third space blocking a direct path between said sound outlet and said wall opening for the propagation of airborne sound and supplying at least one indirect bypass for the propagation of airborne sound between said sound outlet and said wall opening.

2. The exhaust muffler according to claim 1, said labyrinth comprises at least one insulation wall having a first side facing said outlet sound and a second side facing said wall opening, said wall completely covering said sound outlet and said wall opening and permitting transmission of airborne sound between said first side and said second side along at least one edge.

3. The exhaust muffler according to claim 2, wherein said insulation wall is adapted to be permeable for airborne sound at its said edge.

4. The exhaust muffler according to claim 2, wherein said insulation wall is arranged at a distance from an outside wall encompassing said third space.

5. The exhaust muffler according to claim 2, wherein said insulation wall is at least partially of thermal insulation.

6. The exhaust muffler according to claim 2, wherein said insulation wall is designed at least partially as a hollow wall.

7. The exhaust muffler according to claim 6, wherein said insulation wall is filled at least partially with a thermal insulation material.

8. The exhaust muffler according to claim 2, wherein said insulation wall is made of a thermal insulation material.

9. The exhaust muffler according to claim 2, wherein said insulation wall runs parallel to a bordering wall, said bordering wall containing said sound outlet and bordering said third space.

10. The exhaust muffler according to claim 2, wherein said insulation wall runs parallel to said partition.

11. The exhaust muffler according to claim 1, wherein said labyrinth provides at least two bypasses for indirect transmission of the airborne sound between said sound outlet and said wall opening.

12. The exhaust muffler according to claim 2, wherein said sound outlet is arranged in said bordering wall, said bordering wall bordering said third space and extending parallel to said partition.

13. The exhaust muffler according to claim 12, wherein said wall opening and said sound outlet are arranged offset to one another in said partition and bordering wall respectively.

14. The exhaust muffler according to claim 1, wherein said antisound generator is mounted on said partition and is arranged at a distance from a wall otherwise bordering said second space.

15. The exhaust muffler according to claim 1, wherein said second space includes an airtight seal with respect to the outside.

16. The exhaust muffler according to claim 1, wherein a fourth space is provided in said housing and operative as a Helmholtz resonator to which said pipe system is connected upstream from said first space.

17. The exhaust muffler according to claim 15, wherein said pipe system passes through said fourth space with a pipe section.

18. The exhaust muffler according to claim 15, wherein said fourth space is airtight.

19. The exhaust muffler according to claim 1, wherein a fifth space is provided in said housing and is designed as an absorption chamber to which said pipe system is connected downstream from said first space.

20. The exhaust muffler according to claim 19, wherein said fifth space is filled with a sound-absorbing material.

21. The exhaust muffler according to claim 19, wherein said pipe system passes through said fifth space with a pipe section permeable for airborne sound.

22. The exhaust muffler according to claim 19, wherein said fifth space includes an airtight seal to the outside.

23. The exhaust muffler according to claim 1, wherein said first space is separated from said third space by a wall section, said wall section adapted to be permeable for airborne sound to form said sound outlet.

24. The exhaust muffler according to claim 1, wherein said pipe system connects an exhaust inlet of said housing directly to an exhaust outlet of said housing.

25. The exhaust muffler according to claim 1, wherein said pipe system has a perforated pipe section in said first space.

26. The exhaust muffler according claim 1, wherein said pipe system has a perforated pipe section in said fifth space.

27. The exhaust muffler according to claim 1, wherein said wall section separating said first space from said third space is perforated.

28. The exhaust muffler according to claim 1, wherein said insulation wall has at least one perforated section on its edge, which is connected to said outside wall bordering said third space.

* * * * *

UNITED STATES PATENT AND TRADEMARK OFFICE

CERTIFICATE OF CORRECTION

PATENT NO. : 7,293,627 B2
APPLICATION NO. : 11/205753
DATED : November 13, 2007
INVENTOR(S) : Jan Kruger and Frank Castor It is certified that error appears in the above-identified patent and that said Letters Patent is hereby corrected as shown below:

On the Title Page, Item (73), line 1, change "J. Eberspeecher GmnH" to --J. Eberspaecher GmbH--.

Signed and Sealed this

Second Day of December, 2008

JON W. DUDAS
*Director of the United States Patent and Trademark Office*